US005865022A

United States Patent [19]

Bode et al.

[11] Patent Number: 5,865,022

[45] Date of Patent: Feb. 2, 1999

[54] METHOD AND APPARATUS FOR PIECING A BROKEN YARN AT AN OPEN END SPINNING STATION

[76] Inventors: Eike-Thomas Bode, Hohenzollernstrasse 212, 41063 Mönchengladbach; Gerd Jansen, Junkershütte 34, 41748 Viersen, both of Germany

[21] Appl. No.: 929,194

[22] Filed: Sep. 8, 1997

[30] Foreign Application Priority Data

Sep. 7, 1996 [DE] Germany ..... 196 36 395.0

[51] Int. Cl.[6] ..... D01H 13/26

[52] U.S. Cl. ..... 57/263; 57/261

[58] Field of Search ..... 57/261, 263

[56] References Cited

U.S. PATENT DOCUMENTS

| | | | |
|---|---|---|---|
| 4,132,056 | 1/1979 | Husges et al. | 57/263 |
| 4,223,517 | 9/1980 | Husges et al. | 57/263 |
| 4,356,692 | 11/1982 | Karl et al. | 57/263 |
| 4,967,549 | 11/1990 | Lovas et al. | 57/263 |

FOREIGN PATENT DOCUMENTS

| | | |
|---|---|---|
| 33 38 833 A1 | 5/1985 | Germany . |
| 34 28 890 A1 | 2/1986 | Germany . |
| 35 36 911 A1 | 5/1987 | Germany . |
| 40 28 465 A1 | 3/1992 | Germany . |
| 4313523 | 10/1994 | Germany . |

OTHER PUBLICATIONS

W. Schlafhorst AG & Co. "AUTOCORO®–Definitions", May 1985, 11 pages.

*Primary Examiner*—William Stryjewski

[57] ABSTRACT

A method and apparatus for piecing a broken end of yarn at an open end spinning station utilizing a piecing cart servicing the spinning station. To repair the yarn break, a defined yarn length is unwound off the winding bobbin and is temporarily stored in a yarn reservoir disposed between a yarn draw-off device and a lap drive of the piecing cart. Subsequently, the winding bobbin is acceleratively driven by the lap drive sufficiently in advance of actuating the yarn draw-off device to achieve a predetermined winding speed as of the time the withdrawal of spun yarn from the spinning unit resumes.

11 Claims, 3 Drawing Sheets

METHOD AND APPARATUS FOR PIECING A BROKEN YARN AT AN OPEN END SPINNING STATION

FIELD OF THE INVENTION

The present invention relates to the piecing a broken yarn at a spinning station of an open end spinning machine by means of a service unit for supplying the spinning stations of the machine, and more particularly to a piecing operation wherein a trailing end of yarn from a winding bobbin is pieced in an open end spinning unit to fibers fed into the spinning unit to be formed therein into a yarn so that the yarn produced in the spinning unit is wound onto the winding bobbin accelerated by a winding power take-off.

BACKGROUND OF THE INVENTION

Open end spinning machines, such as are known, for example, from the manual "Autocore" of W. Schlafhorst & Co., have a plurality of aligned work stations, which are serviced during the spinning operation by an automatically operating service unit, often referred to as a piecing cart, which can be moved along the work stations.

As described, for example, in German Patent Publication DE 43 13 523 A1, the piecing cart can exchange finished yarn cheeses for empty winding tubes and can also repair yarn breaks at the spinning stations. In case of a yarn break, the piecing cart first cleans the respective spinning station and thereafter reattaches the yarn with the fibers being spun within the spinning station by a so-called piecing operation.

Automatic yarn piecing by the piecing cart takes place within a predetermined range of rotational speeds (rpm) of the spinning rotor which are optimal for piecing. Accordingly, the piecing cart is equipped with a device for measuring the rotor speed. Following cleaning, the cart starts the speed measurement when a rotor brake is disengaged from the rotor shaft and the rotor is accelerated to its operating speed. The actual yarn piecing cycle is started at predetermined optimal piecing speed.

So that the pieced yarn has a continuous thickness and twist during the continuing acceleration of the rotor to its operating speed, the draw-in of fibers into the rotor and the draw-off of yarn from the rotor must be accelerated in the same way as the rotor speed increases.

During the piecing process the piecing cart therefore takes over the drawing-in of the fiber into the spinning unit as well as the yarn draw-off from the spinning unit, and at the same time also accelerates a drive of the cheese onto which the yarn is being wound. The drive of the cheese, which may also be called a winding bobbin, is performed in this case by means of a so-called lap drive. The lap drive has a drive roller disposed at the end of a drive arm, which is pivoted against the surface of the winding bobbin for accelerating it.

This known method has proven effective in actual use and is employed in connection with a number of open end rotor spinning machines. However, as the productivity of open end rotor spinning machines has continued to increase, very high rotor speeds and correspondingly high yarn draw-off speeds have become common. This increase in the yarn draw-off speed makes it likely that in the future difficulties will arise during the piecing process, since the present-day lap drives are not well suited to accelerate large yarn bobbins, which have a correspondingly high moment of inertia, sufficiently that the yarn winding speed can follow the high acceleration of the yarn draw-off device. In this context it must be taken into consideration that the moment transfer by means of a friction wheel is limited, even if the acceleration capability of such drives can be optimized, for example by means of the material selected for the drive roller, its contact pressure against the winding bobbin, its looping around the yarn roller, the pressure surface of the latter and its profile.

OBJECT AND SUMMARY OF THE INVENTION

In light of the above described state of the art in piecing up a yarn end at an open end spinning station following a yarn break, it is a basic object of the present invention to improve the known methods and devices.

In accordance with the invention this object is attained by providing a method for piecing a broken end of wound yarn from a winding bobbin to fibers being spun into yarn within a spinning unit at an open end spinning station, utilizing a spinning station service unit for driving the winding bobbin and withdrawing spun yarn from the spinning unit during restarting of spinning operation of the spinning station. According to the present invention, the method basically comprises the steps of inserting the broken end of the wound yarn into the spinning unit and unwinding a defined length of the wound yarn off the winding bobbin and temporarily storing the unwound yarn in a yarn reservoir on the service unit. Thereafter, the driving of the winding bobbin is initiated sufficiently in advance of initiating withdrawal of spun yarn from the spinning unit for accelerating the winding bobbin to a first predetermined winding speed as of the time the withdrawal of spun yarn from the spinning unit resumes.

In the preferred embodiment of the present method, the length of unwound yarn temporarily stored in the yarn reservoir approximately corresponds to the yarn length which is wound on the winding bobbin during restarting of spinning operation of the spinning station. The winding bobbin is accelerated from the first predetermined winding speed to a second predetermined winding speed approximately corresponding to the yarn withdrawal speed at an optimum piecing speed of the spinning unit. In one variant of the present method, the winding bobbin is accelerated from the second predetermined winding speed synchronously with the yarn withdrawal until reaching a predetermined production speed of normal spinning operation of the spinning station, during which acceleration the bobbin acceleration follows that of the spinning unit to the predetermined production speed. In another variant of the method, the winding bobbin accelerates from the second predetermined winding speed at a slower rate than the yarn withdrawal until reaching a predetermined production speed of normal spinning operation of the spinning station for storing a length of the spun yarn in the yarn reservoir. Which one of these variants is more advantageous in a given case depends on a number of parameters, which can be determined by means of appropriate tests.

The present invention also provides an apparatus for carrying out the aforedescribed method of piecing a broken end of wound yarn from a winding bobbin to fibers being spun into yarn within a spinning unit at an open end spinning station. Basically, the apparatus comprises a spinning station service unit having a drive for driving the winding bobbin, a yarn draw-off device for withdrawing spun yarn from the spinning unit during restarting of spinning operation of the spinning station, a yarn reservoir for temporarily storing a length of yarn, and means for inserting the broken end of the wound yarn into the spinning unit. According to the present invention, control means is also provided for actuating the drive and the yarn reservoir for unwinding a defined length of the wound yarn off the winding bobbin and temporarily storing the unwound yarn in the yarn reservoir and for thereafter initiating the driving of the winding bobbin sufficiently in advance of the yarn draw-off device for accelerating the winding bobbin to a first predetermined winding speed as of the time the withdrawal of spun yarn from the spinning unit resumes.

In the preferred embodiment of the apparatus, the yarn reservoir is operative intermittently or discontinously and is arranged for the stored yarn to be exhausted by first withdrawing the last extent of yarn placed into the reservoir, referred to herein as the "last in-first out" principle. Preferably, the yarn reservoir comprises an entrance tube opening into an adjoining conical reservoir having a perforated bottom wall formed with a plurality of bores, the radially outwardmost of which are of a larger diameter. A source of suction is applied to the bottom wall of the yarn reservoir to draw the stored yarn into the reservoir.

The basic operation of the afore-mentioned method and apparatus of the present invention proceeds from the realization that, with further increasing yarn draw-off speeds of open end spinning machines, it will become very difficult in the future to accomplish the acceleration of the winding bobbin necessary during the piecing process utilizing the lap drives of currently conventional service units known as piecing carts, even at a maximally acting moment of acceleration.

It is therefore proposed by the present invention to separate chronologically the process of accelerating the winding bobbin from the yarn draw-off process, thereby to avoid the problematic process of accelerating the winding bobbin by starting the acceleration of the winding bobbin at a time sufficiently in advance of the piecing process that the winding bobbin has already been accelerated by the lap drive to a predetermined winding speed as of the time the yarn draw-off from the rotor begins.

The acceleration of the winding bobbin is preferably begun sufficiently in advance of the start of yarn draw-off from the rotor so that, by the time of the yarn draw-off step is started, the winding speed of the winding bobbin almost corresponds to the yarn draw-off speed.

In order to have a sufficient length of yarn available for winding over the period of time from the start of the pre-acceleration of the winding bobbin to the start of the yarn draw-off, a defined length of yarn is pulled from the winding bobbin prior to the start of the piecing process and is temporarily stored in a yarn reservoir disposed between the yarn draw-off device and the lap drive. The length of yarn stored in the yarn reservoir is determined in this case to compensate for the difference in yarn length which occurs because of the chronologically offset start of the lap drive and of the yarn draw-off.

The predetermined wind-up speed to which the lap drive accelerates the winding bobbin is preferably a function of the optimum piecing speed of the spinning rotor, or a function of the yarn draw-off speed corresponding to this rotor speed.

In a preferred manner, the piecing cart which executes the method has a separate drive for the lap drive accelerating the winding bobbin, and a separate drive for the yarn draw-off device. The drives are connected to the control device of the piecing cart and can be programmed in a defined manner.

In performing the present method, a yarn guide is inserted between the yarn draw-off device and the lap drive to withdraw from the winding bobbin a sufficient length of yarn to enable a time-offset start of the lap drive and the yarn draw-off device. The length of yarn brought back from the winding bobbin and stored in the yarn reservoir in this case permits even large cheeses, which are known to have a considerable moment of inertia, to be accelerated in sufficient time and at a relatively gentle rate to the high rotational winding speed necessary for the piecing process. In this manner, high acceleration speeds for drawing-off the yarn from the rotor are controllable during the piecing process with the present invention, even if there are large winding bobbins involved.

As explained above, in a preferred embodiment the yarn reservoir is arranged to function as a discontinuously operating reservoir in accordance with a "last in-first out" principle under which the last extent of yarn brought into the reservoir is pulled out first in the process of pre-accelerating the winding bobbin. A reservoir of this type has the advantage that the uppermost extent of yarn closest to the winding bobbin is always pulled out first, so that snarls, tangles and the like in the yarn can be avoided to the greatest possible extent.

The described structure and operation of the reservoir result in an uncomplicated, dependably operating reservoir, which can be easily cleaned when required. The perforated bottom wall of the reservoir further results in pressure conditions in the area of the bottom wall which assure that, even at larger yarn lengths, an orderly deposition of the yarn into the reservoir in loops is accomplished with the loops starting in the edge area of the reservoir becoming smaller towards the interior.

Further details and features of the present invention will be understood from an exemplary embodiment of the present invention described below with reference to the accompanying drawings.

DETAILED DESCRIPTION OF THE PREFERRED EMBODIMENT

Figure 1:
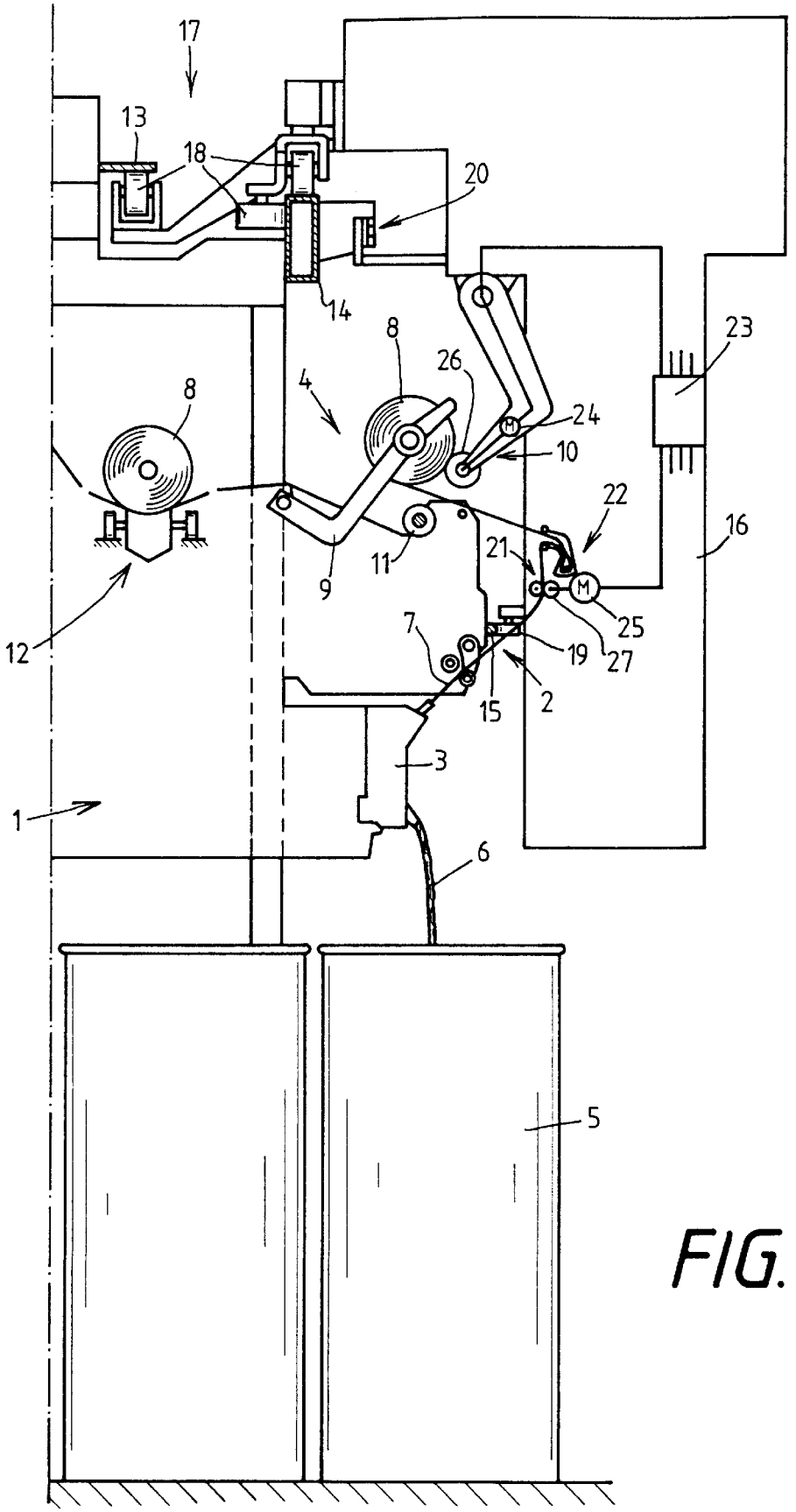
FIG. 1 is a schematic side elevational view of an open end rotor spinning machine showing one representative spinning station with a piecing cart also schematically represented thereat.

Referring now to the accompanying drawings and initially to FIG. 1, one side of an open end rotor spinning machine is indicated schematically and identified as a whole by 1. In such spinning machines, each machine side has a plurality of work stations 2 aligned with one another, with the aligned stations of each side arranged back-to-back and with each spinning station being equipped with a spinning unit 3 and a winding device 4. At each station, a sliver 6 delivered from a sliver can 5 is spun in the spinning unit 3 into a yarn 7, which is withdrawn and wound into the form of a cheese 8 by a winding device 4.

As represented, each winding device 4 is equipped with a bobbin frame 9 for rotatably supporting a winding bobbin 8 while being formed into a cheese, and a winding drum 11 for driving the winding bobbin during normal winding operations.

In addition, the open end rotor spinning machine 1 has a circulating tube and bobbin transport device 12 for providing the work stations of the spinning machine with empty tubes and for moving away the finished cheeses.

A service unit, for example a piecing cart 16, is disposed at or on the spinning machine 1 and is movable on guide rails 13, 14 and a support rail 15 along the aligned spinning stations by means of rollers 18 and a support wheel 19 forming the running gear 17 for this piecing cart 16. The piecing cart 16 is preferably supplied with operating electrical energy, as indicated, via a sliding contact device 20.

Such piecing carts 16 are known to have numerous winding and yarn manipulation devices, for example a lap drive 10 and a yarn draw-off device 21, and continuously patrol along the open end rotor spinning machine 1 until there is need for action at one of the work stations 2, whereupon the piecing cart 16 is automatically stopped at the station needing service and is actuated to perform the necessary service operation. Such a need for action exists, for example, if a yarn break has occurred at a work station 2, or when a cheese 8 has reached its prescribed diameter at one of the work stations and needs to be exchanged for an empty tube.

In such a case the piecing cart 16 moves to the appropriate work station, is positioned there and, in case of most yarn breaks, i.e., a "normal" yarn break, searches with a pneumatic yarn seeking nozzle (not shown) for the torn yarn end trailing from on the circumferential surface of the winding bobbin 8. Following the cleaning of the spinning unit, the located yarn end is brought back in a known customary manner after appropriate yarn end preparation into the area of the spinning unit 3 by means of known manipulating devices, and is threaded thereat into the yarn draw-off tube to be kept ready for the actual piecing process. Simultaneously, a defined length of yarn is unwound off the winding bobbin 8 by means of the lap drive 10, and is temporarily stored in a yarn reservoir 22.

Figure 2:
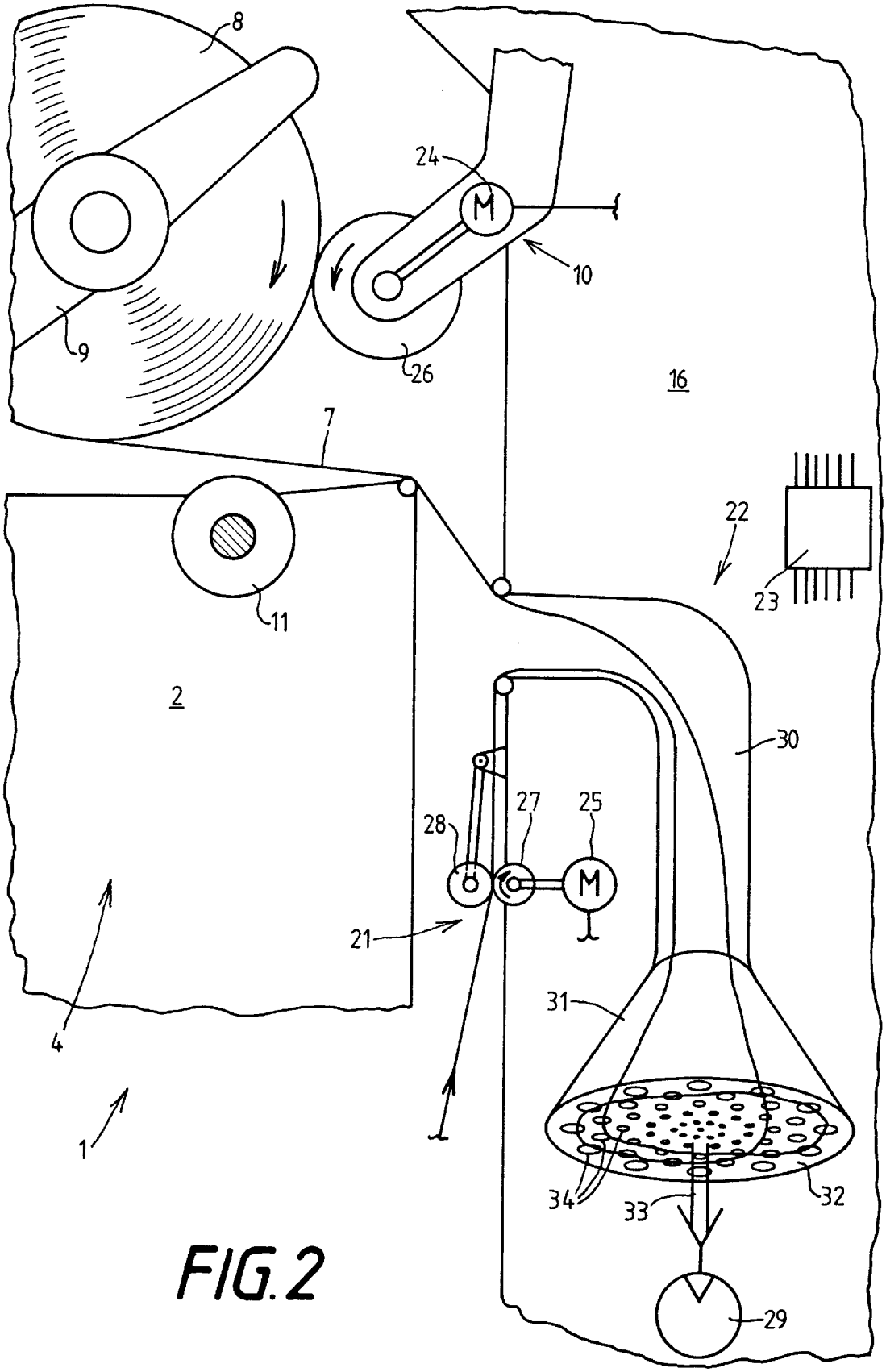
FIG. 2 is a partial enlargement of the area of the spinning station of FIG. 1, as well as an adjacent portion of the piecing cart, depicting in particular the lap drive, the yarn draw-off device and the discontinuously operating yarn reservoir.

As represented on a larger scale in FIG. 2, both the lap drive 10 and the yarn draw-off device 21 have their own respective drives 24 or 25, which can be directly controlled by a control device 23 which is part of the piecing cart. The drive 24 acts on a drive roller 26 of the lap drive 10, while the drive 25 is connected to a draw-off roller 27 of the yarn draw-off device 21 of the piecing cart 16. As is customary, the yarn draw-off device 21 also has an opposing pressure nip roller 28.

The yarn reservoir 22 is arranged between the yarn draw-off device 21 and the lap drive 10. The yarn reservoir 22 operates discontinuously, i.e., it is emptied during each piecing process, operates in accordance with the "last in-first out" principle as afore-mentioned, and can be charged with suction air via an negative pressure source 29.

In the exemplary embodiment represented in the drawings, the yarn reservoir 22 consists of a small reservoir tube 30 opening into an enlarged reservoir cone 31 having a perforated bottom plate 32 which is connected to the suction source 29 via a connecting line 33. The bottom plate 32 has a plurality of tapering bores 34, whose diameter preferably becomes smaller towards the interior of the cone, so that a suction air flow 33 with different pressure conditions is present in the area of the bottom plate 32, i.e., the suction pressure which fixes the yarn 7 pulled off the winding bobbin 8 in the area of the bottom plate 32 is reduced from the outside of the cone toward the inside of the cone corresponding to the size of the bores 34.

The method in accordance with the present invention basically makes possible the piecing even of large winding bobbins at high yarn draw-off speeds by means of a corresponding pre-acceleration of the winding bobbin, as will be explained below by means of two contemplated embodiments graphically represented in FIG. 3 and FIG. 4.

Figure 3:
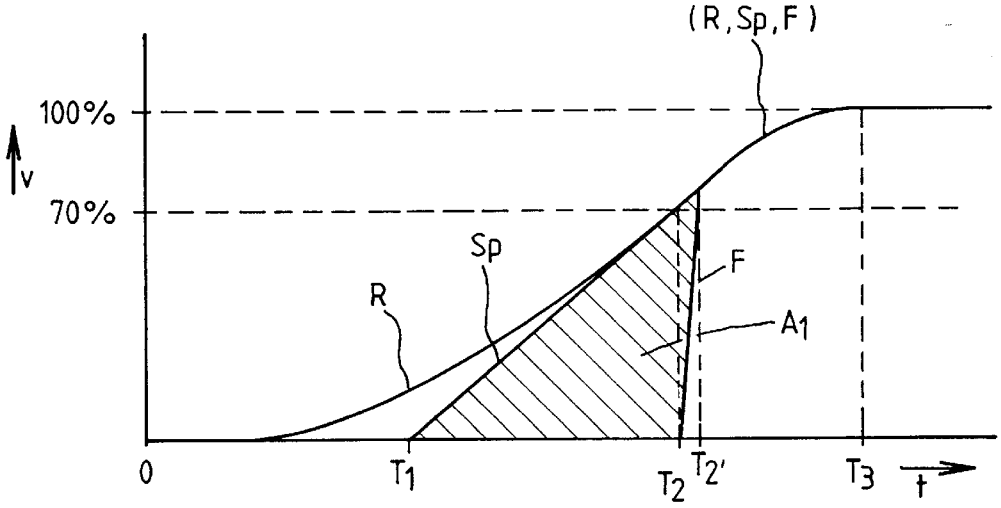
FIG. 3 is a graph diagrammatically representing the operation of a first variant of the method in accordance with the present invention.
Figure 4:
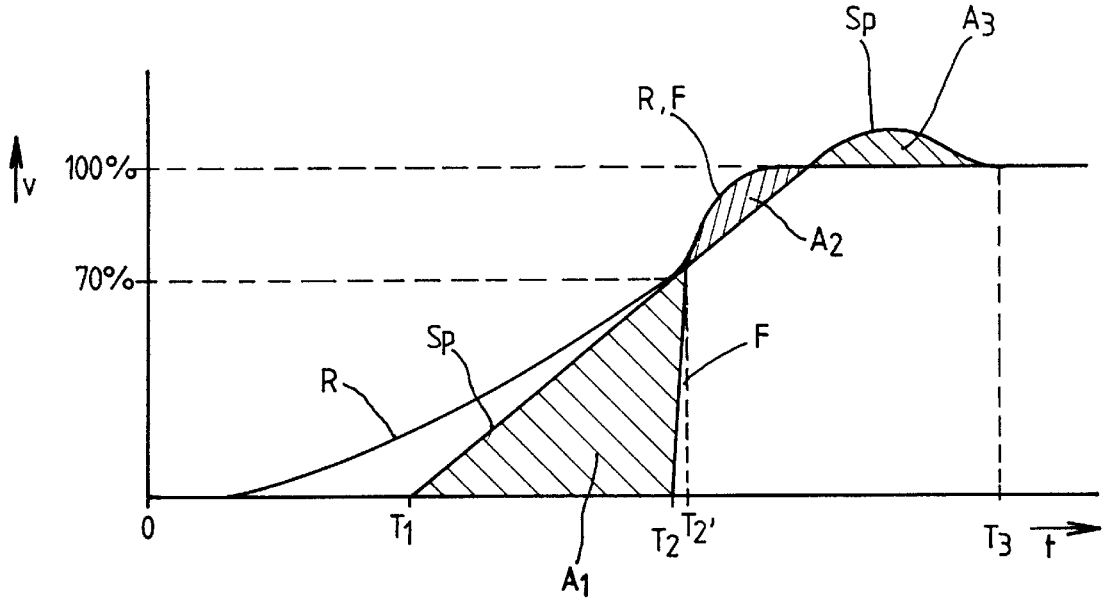
FIG. 4 is another graph diagrammatically representing the operation of a second variant of the method of the present invention.

In the graphs of FIGS. 3 and 4, the coordinate system represented plots a time t along the abscissa of the graph and a production speed v of a spinning station during the piecing process along the ordinate of the graph. The curves R, Sp, F respectively represent the course of acceleration of the rotor, the winding bobbin and the yarn draw-off device.

Referring initially to FIG. 3, it can be seen that, in this embodiment, the rotor, which is braked during the cleaning process, thereafter accelerates at a rate represented by the curve R to an optimum yarn piecing speed (rpm), which correspond to approximately 70% of the production speed of the rotor (rpm), reaching this piecing speed after an elapsed time T2. The yarn draw-off device is not started until this time T2 but, based on the relatively low moment of inertia of the yarn draw-off device, is accelerated very rapidly, as represented by the curve F, to a high yarn draw-off speed which, as of the elapsed time T2', achieves a yarn draw-off speed which corresponds to the rotor speed at this same point in time. As represented by the curve Sp, the lap drive 10 is started at the time T1 to begin accelerating the winding bobbin 8 earlier during the acceleration of the rotor to the optimum piecing speed for the lap drive. The length of time between times T1 and T2 is selected according to the accelerating capability of the lap drive 10 so that the winding speed of the winding bobbin approximately corresponds to the yarn draw-off speed at the time T2'.

From the time T2', the rotor, the yarn draw-off device and the lap drive are accelerated synchronously, with the accelerating speed of the rotor constitute the command variable. As of the subsequent point in time T3, the spinning rotor, the yarn draw-off device and the winding bobbin reach their full normal production speed (100%). Since as of the time T1 when the lap drive 10 is started the spinning unit 3 has not yet resumed production of yarn and correspondingly no yarn is being delivered at such time via the yarn draw-off device 21, a reserve length of yarn must be provided to be taken up by the bobbin 8 while being thusly driven by the lap drive 10 during the period between the time T1 and the time T2', which is provided by the extent of yarn previously unwound off the winding bobbin and stored in the reservoir 22. The required yarn length which needs to be unwound from the winding bobbin 8 is represented by the area A1 in FIG. 3.

With reference now to FIG. 4, the alternative variant of the present method represented therein is identical to that of the exemplary embodiment of FIG. 3 up to the time T2', i.e., up to the time at which the yarn reserve A1 placed in the yarn reservoir 22 is exhausted by the pre-acceleration of the winding bobbin 8, and the bobbin winding speed and the yarn draw-off speed are identical at least for such moment. In this embodiment, beginning at the time T2', the yarn draw-off device, following the rotor speed as a command variable, is accelerated faster than the lap drive 10 is able to accelerate the relatively heavy winding bobbin 8, so that an excess of yarn is produced between the rotor and the bobbin. This yarn excess is also temporarily drawn into and stored in the yarn reservoir 22 until finally reaching an excess yarn length A2, whereby the yarn reservoir 22 still contains the yarn length A2 at the time when the rotor and the yarn draw-off device initially reach their full production speed, which are identified at the 100% level of value v in the diagram. In order to empty this yarn excess A2 from the yarn reservoir 22, it is therefore necessary to briefly accelerate the lap drive 10 to a speed which, as indicated in FIG. 4, temporarily exceeds the production speed of the spinning station and therefore exceeds the yarn draw-off speed. In this case, the winding speed of the winding bobbin and the yarn draw-off speed are matched in such a way that the additional yarn length A3 needed to be taken up by the bobbin in this case exactly corresponds to the yarn length A2 just theretofore temporarily stored in the yarn reservoir 22. Accordingly, at the subsequent point in time T3 at which the yarn reservoir 22 is empty again, the lap drive 10 returns to its normal full production speed and the spinning station again resumes normal winding operation.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for piecing a broken end of wound yarn from a winding bobbin to fibers being spun into yarn within a spinning unit at an open end spinning station, the method utilizing a spinning station service unit for driving the winding bobbin and withdrawing spun yarn from the spinning unit during restarting of spinning operation of the spinning station, the method comprising inserting the broken end of the wound yarn into the spinning unit, unwinding a defined length of the wound yarn off the winding bobbin and temporarily storing the unwound yarn in a yarn reservoir disposed on the service unit between the winding bobbin and the location of yarn withdrawal from the spinning unit, and thereafter initiating the driving of the winding bobbin sufficiently in advance of initiating withdrawal of spun yarn from the spinning unit for accelerating the winding bobbin to a first predetermined winding speed as of the time the withdrawal of spun yarn from the spinning unit resumes.

2. The method in accordance with claim 1, wherein the length of unwound yarn temporarily stored in the yarn reservoir approximately corresponds to the yarn length which is wound on the winding bobbin during restarting of spinning operation of the spinning station.

3. The method in accordance with claim 1, and further comprising accelerating the winding bobbin from the first predetermined winding speed to a second predetermined winding speed approximately corresponding to the yarn withdrawal speed at an optimum piecing speed of the spinning unit.

4. The method in accordance with claim 3, and further comprising accelerating the winding bobbin from the second predetermined winding speed synchronously with the yarn withdrawal until reaching a predetermined production speed of normal spinning operation of the spinning station, said acceleration following acceleration of the spinning unit to the predetermined production speed.

5. The method in accordance with claim 3, and further comprising accelerating the winding bobbin from the second predetermined winding speed at a slower rate than the yarn withdrawal until reaching a predetermined production speed of normal spinning operation of the spinning station for storing a length of the spun yarn in the the yarn reservoir.

6. An apparatus for piecing a broken end of wound yarn from a winding bobbin to fibers being spun into yarn within a spinning unit at an open end spinning station, the apparatus comprising a spinning station service unit having a drive for driving the winding bobbin, a yarn draw-off device for withdrawing spun yarn from the spinning unit during restarting of spinning operation of the spinning station, a yarn reservoir for temporarily storing a length of yarn, means for inserting the broken end of the wound yarn into the spinning unit, and control means for actuating the drive and the yarn reservoir for unwinding a defined length of the wound yarn off the winding bobbin and temporarily storing the unwound yarn in the yarn reservoir and for thereafter initiating the driving of the winding bobbin sufficiently in advance of the yarn draw-off device for accelerating the winding bobbin to a first predetermined winding speed as of the time the withdrawal of spun yarn from the spinning unit resumes.

7. The apparatus in accordance with claim 6, wherein the yarn reservoir is operative intermittently.

8. The apparatus in accordance with claim 6, wherein the yarn reservoir is arranged for the stored yarn to be exhausted by first withdrawing the last extent of yarn placed into the reservoir.

9. The apparatus in accordance with claim 6, wherein the yarn reservoir comprises an entrance tube opening into an adjoining conical reservoir having a perforated bottom wall.

10. The apparatus in accordance with claim 9, wherein the bottom wall is formed with a plurality of bores, the radially outwardmost bores being of a larger diameter.

11. The apparatus in accordance with claim 9, and further comprising a source of suction applied to the bottom wall of the yarn reservoir.

* * * * *

UNITED STATES PATENT AND TRADEMARK OFFICE

CERTIFICATE OF CORRECTION

PATENT NO. : 5,865,022

DATED : February 2, 1999

INVENTOR(S) : Bode et al.

It is certified that error appears in the above-identified patent and that said Letters Patent is hereby corrected as shown below:

On the title page insert
--[73]Assignee:

W. Schlafhorst AG & Co.

Moenchengladbach
Fed Rep Germany --.

Signed and Sealed this

Sixth Day of July, 1999

*Attest:*

Q. TODD DICKINSON

*Attesting Officer*

*Acting Commissioner of Patents and Trademarks*